US007950655B2

(12) United States Patent
Park et al.

(10) Patent No.: US 7,950,655 B2
(45) Date of Patent: May 31, 2011

(54) APPARATUS AND METHOD FOR CONTROLLING VARIOUS KINDS OF PAPER MEDIA WITH SKEW SENSING

(75) Inventors: Chang Ho Park, Gyeonggi-do (KR); Jin Yong Hwang, Gyeonggi-do (KR)

(73) Assignee: Nautilus Hyosung Inc., Seoul (KR)

( * ) Notice: Subject to any disclaimer, the term of this patent is extended or adjusted under 35 U.S.C. 154(b) by 519 days.

(21) Appl. No.: 11/965,987

(22) Filed: Dec. 28, 2007

(65) Prior Publication Data

US 2008/0210605 A1 Sep. 4, 2008

(30) Foreign Application Priority Data

Dec. 29, 2006 (KR) ..... 10-2006-0138916

(51) Int. Cl.
*B65H 7/08* (2006.01)

(52) U.S. Cl. ..... 271/261; 271/10.03; 271/265.01; 271/902

(58) Field of Classification Search ..... 271/261, 271/10.03, 227, 228, 258.01, 259, 265.02, 271/265.03, 902
See application file for complete search history.

(56) References Cited

U.S. PATENT DOCUMENTS 5,443,257 A * 8/1995 Sakamori ..... 271/228
5,527,031 A * 6/1996 Walsh et al. ..... 271/259
5,918,877 A * 7/1999 Takei et al. ..... 271/261
6,062,369 A * 5/2000 Negishi ..... 194/207
6,834,853 B2 * 12/2004 Trovinger et al. ..... 271/227
7,219,888 B2 * 5/2007 Trovinger et al. ..... 271/227
2004/0251610 A1 * 12/2004 Shimomura et al. ..... 271/226
2009/0152800 A1 * 6/2009 Nutzel et al. ..... 271/18

FOREIGN PATENT DOCUMENTS

JP 57145750 A * 9/1982
JP 62259944 A * 11/1987
JP 02095640 A * 4/1990

* cited by examiner

*Primary Examiner* — Stefano Karmis
*Assistant Examiner* — Jeremy Severson
(74) *Attorney, Agent, or Firm* — Fish & Richardson P.C.

(57) ABSTRACT

An apparatus for controlling reception of various kinds of paper media includes a reception unit to allow the various kinds of paper media to be received, a pick-up unit to pick up the paper media from the reception unit one sheet by one sheet, a transport unit to transport the picked up paper media, a separation control sensing unit mounted on the transport unit to sense whether the paper media is passing through a predetermined transport path, a skew sensing unit mounted on the transport unit to sense skew of the paper media, and a control unit to operate the pick-up unit when the separation control sensing unit senses the paper media passing, and to suspend a forward operation of the transport unit and operate the transport unit backwards when the skew sensing unit senses the skew of the paper media.

15 Claims, 8 Drawing Sheets

APPARATUS AND METHOD FOR CONTROLLING VARIOUS KINDS OF PAPER MEDIA WITH SKEW SENSING

CROSS-REFERENCE TO RELATED APPLICATION

This application claims priority from Korean Patent Application No. 10-2006-0138916, filed on Dec. 29, 2006 in the Korean Intellectual Property Office, the entire disclosure of which is incorporated herein by reference.

BACKGROUND OF THE INVENTION

1. Field of the Invention

The present invention relates to an automatic transaction machine, and more particularly, to an apparatus of controlling reception of various kinds of paper media that may detect defects of the paper media and process the paper media with the defects and a method for the same.

2. Description of Related Art

In general, an automatic transaction machine provides basic financial services such as a money reception/dispensing without a bank teller regardless of time and location. The automatic transaction machine is classified into a cash dispensing machine and a cash depositing/dispensing machine depending on money reception/dispensing. Recently, the automatic transaction machine has been used for multiple purposes such as a check reception/dispensing, bank book update, Giro payment, ticket dispensing, and the like, in addition to the money reception/dispensing.

Recently, the automatic transaction machine is widely used in a bank, a financial organization, and the like, and customers frequently use the automatic transaction machine due to convenience of use. In this regard, transaction amounts have been accordingly increased due to an increase of the types of uses of the automatic transaction machine. A large amount of cash is deposited and dispensed according to the increase in transaction amounts, and accordingly, undesirable problems are caused in the automatic transaction machine due to mutual movement and interference in positioning of the large amount of cash.

The automatic transaction machine in which reception of paper media is processed is required to allow various kinds of paper media to be received. However, it is difficult task for the automatic transaction machine to process various kinds of paper media with different sizes and different sheet conditions. For example, paper media with a relatively shorter size is likely to be abnormally arranged in the machine with a relatively greater size due to their different sizes. The paper media is likely to be transported in a state of being abnormally arranged, for example, in a state of being skewed, and thus this can become causes of failure and malfunction of the automatic transaction machine.

Also, various kinds of paper media with different sizes are transported in uneven states of the paper media, such as being skewed, partially folded, folded in half, and the like. Accordingly, even in the case of one kind of paper media, there arise many problems in the transport of the paper media, such as the above-described uneven states of the paper media. Also, in the case of various kinds of paper media with different sizes, locations where the defects are sensed differ from one another depending on each size of the various kinds of paper media.

Because of the above-described problems, it is difficult for an automatic transaction machine for handling various kinds of paper media to be realized. Also, in general, the automatic transaction machine in which reception of paper media is processed disadvantageously handles only one kind of paper media.

SUMMARY OF THE INVENTION

An aspect of the present invention provides an apparatus of controlling reception of various kinds of paper media and a method for the same that may readily process various kinds of paper media.

An aspect of the present invention provides an apparatus of controlling reception of various kinds of paper media and a method for the same that may detect abnormalities of paper media and abnormal position of the paper media such as skew of the paper media and the like, so that paper media with the abnormalities are prevented from being processed in an automatic transaction machine.

An aspect of the present invention provides an apparatus of controlling reception of various kinds of paper media and a method for the same in which configuration and arrangement of sensors may be maintained taking into consideration various kinds of paper media such as Euro, Yuan, Won, and the like, to be applicable to an automatic transaction machine processing various kinds of paper media by merely modifying a paper media guide for guiding the transport of the paper media.

According to an aspect of the present invention, there is provided an apparatus of controlling reception of various kinds of paper media, which includes a reception unit to allow the various kinds of paper media to be received; a pick-up unit to pick-up the paper media from the reception unit one sheet at a time; a transport unit to transport the paper media picked up by the pick-up unit; a separation control sensing unit mounted on the transport unit to sense whether the paper media is passing through a predetermined transport path; a skew sensing unit mounted on the transport unit between the reception unit and the separation control sensing unit to sense skew of the paper media; and a control unit to operate the pick-up unit when the separation control sensing unit senses the paper media passing, and to suspend a forward operation of the transport unit and operate the transport unit backwards when the skew sensing unit senses the skew of the paper media.

In this instance, the skew sensing unit and the separation control sensing unit may be consecutively arranged adjacent to the pick-up unit, and the control unit may control operations of the pick-up unit and the transport unit depending on a signal result measured by the skew sensing unit.

For example, when the skew of the paper media is sensed by the skew sensing unit, the control unit may suspend a forward operation of the transport unit and the skewed paper media may be returned to the reception unit, so that the paper media with defects are prevented from being processed in an automatic transaction machine, thereby preventing malfunction of the automatic transaction machine. Also, every time the separation control sensing unit senses a passage of one sheet of the paper media, the control unit may control to permit the pick-up unit to pick up another sheet of the paper media and transmit the picked up sheet. Since, the operation of the pick-up unit is controlled by the separation control sensing unit, an interval between respective sheets of paper media is maintained by a relatively large amount, and thus paper media is prevented from being consecutively folded.

In particular, the transport unit may include a paper media guide for guiding the transport of the paper media. The paper media may be transported along a predetermined transport path by the paper media guide.

Also, the skew sensing unit may include a middle skew sensor disposed in a middle portion of the transport path of the transport unit, and side skew sensors disposed on both sides of the middle skew sensor, respectively. At least three skew sensors are consecutively arranged across the transport path, thereby effectively detecting abnormalities of the paper media and abnormal position of the paper media such as the skew of the paper media and the like. Here, the side skew sensor is preferably disposed in a location where a passage of the paper media with the smallest size, from among the various kinds of paper media, is sensed even when the paper media with the smallest size is in close contact with a side end of the transfer path.

Also, the separation control sensing unit may include a middle separation control sensor disposed on a middle portion of the transport path of the transport unit and a side separation control sensor disposed on both sides of the middle separation control sensor. When a distance between both side skew sensors becomes narrowed considering paper media with a relatively shorter length, paper media with a relatively greater length cannot be detected even in a state of being folded in half. To this end, a distance between the side separation control sensors and the middle separation control sensor is preferably greater than a distance between the side skew sensors and the middle skew sensor, so that paper media with the greatest length are prevented from passing through a predetermined transport path in a state being folded in half.

According to another aspect of the present invention, there is provided a method of controlling reception of various kinds of paper media, which includes picking up one sheet of paper media from among the paper media received from a reception unit receiving the paper media; transporting the picked up paper media using a transport unit; measuring an amount of skew of the paper media using a skew sensing unit mounted on the transport unit; maintaining a forward operation of the transport unit only when a skew angle measured by the skew sensing unit is equal to or less than an allowable amount of skew; sensing whether the paper media is passing through a predetermined transport path using a separation control sensing unit mounted on the transport unit; and picking up another sheet of paper media from among the paper media received from the reception unit after verifying the paper media is passing through the predetermined transport path.

Here, the method of controlling reception of various kinds of paper media specifies from a step of picking up one sheet of paper media to a step of picking up another sheet of paper media. Accordingly, since the latter step corresponds to the former step in another method of controlling reception of paper media, the latter step may be repeated. Also, the method of controlling reception of various kinds of paper media is restrictively performed only when the skew angle measured by the skew sensing unit has a predetermined amount. Thus, when the skew angle exceeds the allowable amount (for example, exceeds about 20°), the forward operation of the transport unit is suspended and the transport unit is operated backwards, thereby returning the paper media to the reception unit.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1:
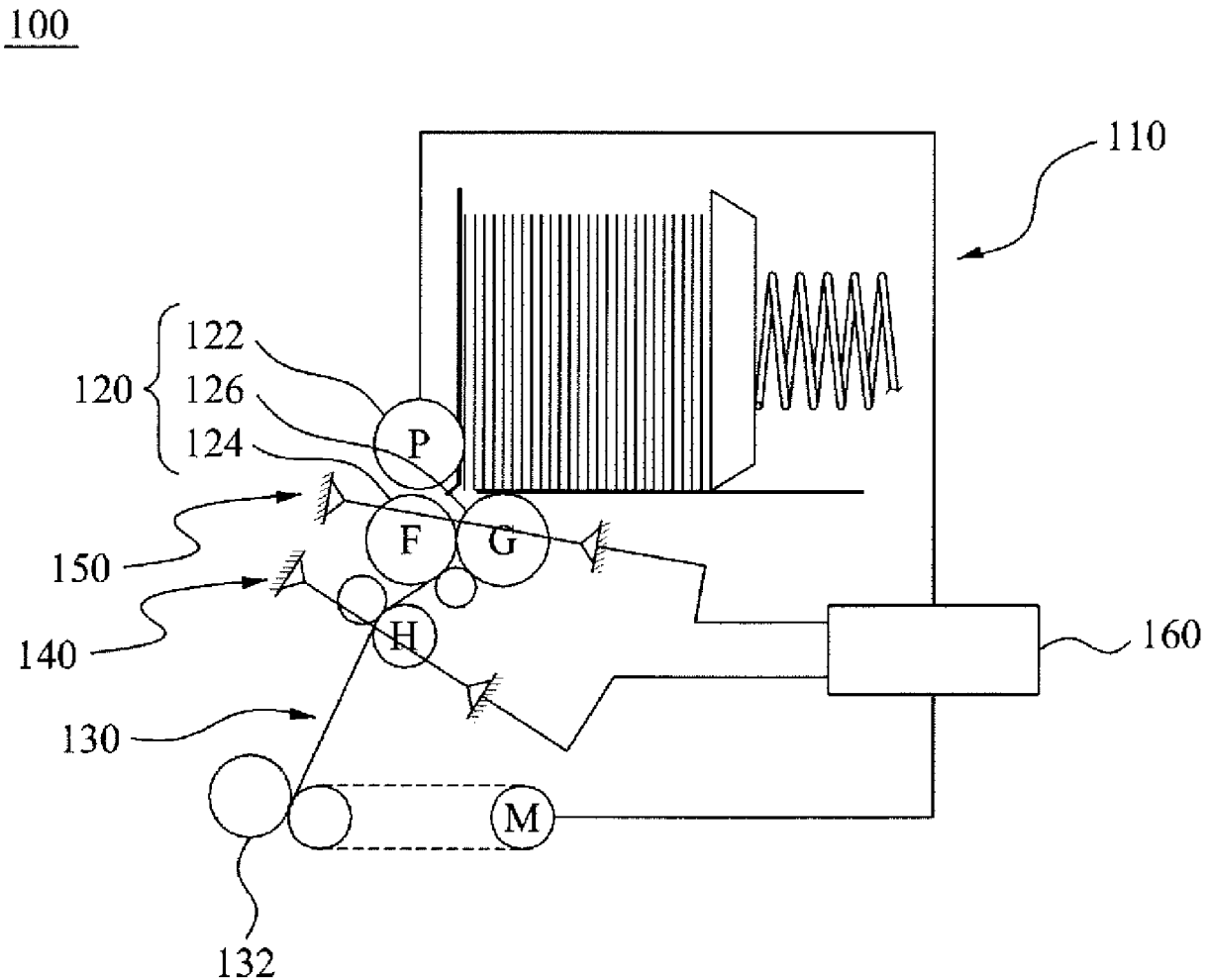
FIG. 1 is a diagram used for describing an apparatus of controlling reception of various kinds of paper media and a method for the same according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

Figure 2:
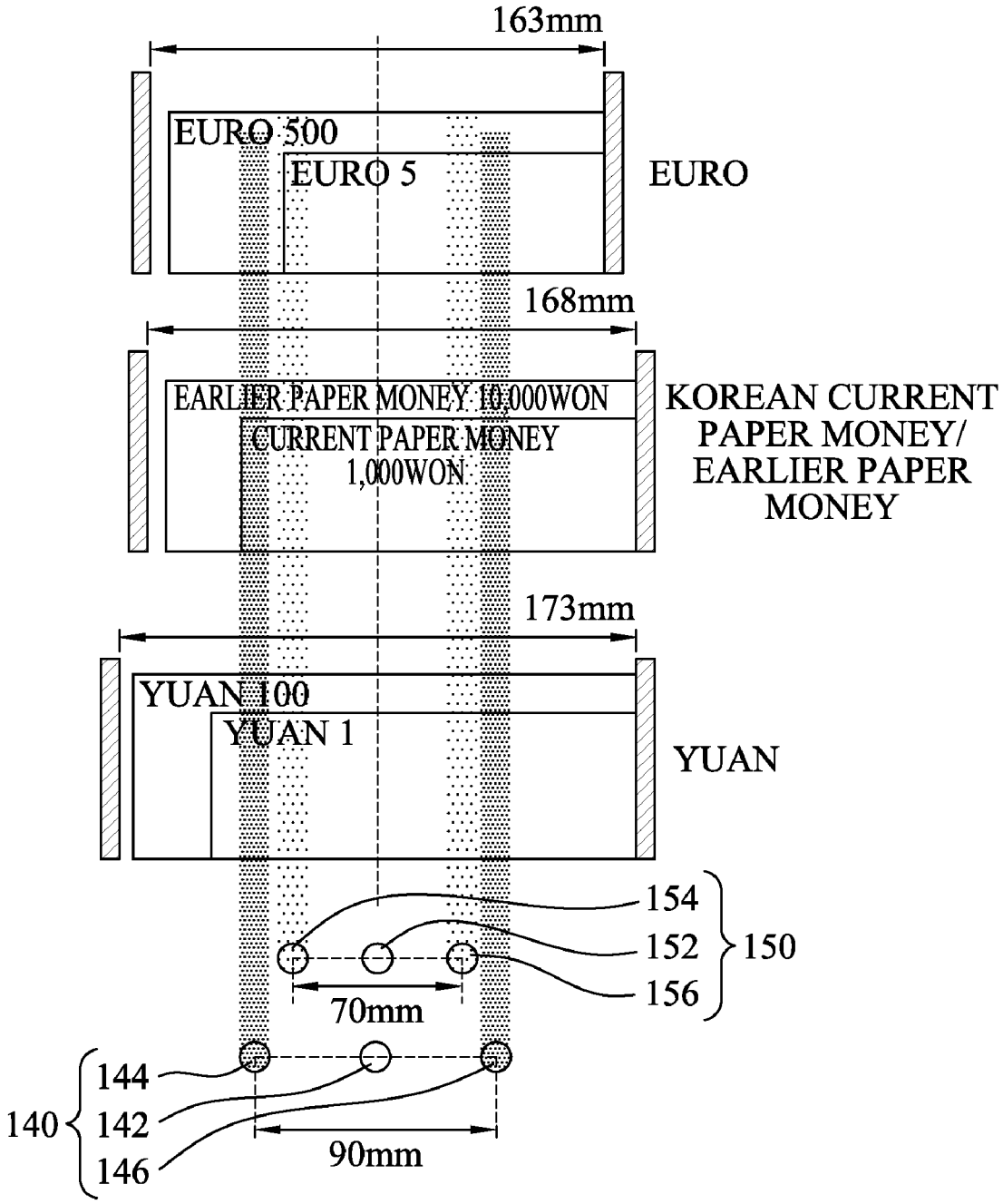
FIG. 2 is a diagram used for describing a skew sensing unit and a separation control sensing unit of FIG. 1.

FIG. 1 is a diagram used for describing an apparatus of controlling reception of various kinds of paper media and a method for the same according to an exemplary embodiment of the present invention, and FIG. 2 is a diagram used for describing a skew sensing unit and a separation control sensing unit of FIG. 1.

Referring to FIGS. 1 and 2, the apparatus 100 of controlling reception of various kinds of paper media according to the present exemplary embodiment of the invention includes a reception unit 110, a pick-up unit 120, a transport unit 130, a separation control sensing unit 140, a skew sensing unit 150, and a control unit 160.

The reception unit 110 receiving various kinds of paper media is formed in a size capable of receiving the various kinds of paper media, and more preferably, formed in a size capable of receiving paper media with the greatest size from among the various kinds of paper media. The pick-up unit 120 picks up the paper media received in the reception unit 110 one sheet at a time, and the picked up paper media may be moved to an inside of an automatic transaction machine via the transport unit 130. Also, the separation control sensing unit 140 is mounted on a transport path to adjust an interval between the paper media, and the skew sensing unit 150 detects abnormal sheets of the paper media and abnormal position of the paper media either alone or in cooperation with the separation control sensing unit 140.

The pick-up unit 120 includes a pick-up roller 122, a feed roller 124, and a gate roller 126. When the received paper media is stacked one on top of another, the pick-up roller 122 picks up one sheet at a time, and the feed roller 124 and the gate roller 126 may transport the picked up sheet to the transport unit 130. The pick-up roller 122, the feed roller 124, and the gate roller 126 may utilize a similar, conventional pick-up mechanism.

The transport unit 130 may transport the paper media transported from the pick-up unit 120 one sheet at a time. The paper media may be transported to a detection unit of the automatic transaction machine by the transport unit 130, and transported to a storage unit within the automatic transaction machine after the paper media is normally processed. The transport unit 130 may be constructed such that the transport path is defined by a guide plate of the transport unit 130, and a driving power is transmitted by rollers 132 mounted on each guide plate. Alternatively, the transport unit 130 may be constructed such that the transport path is defined by rollers 132 cooperating with a circulated belt, and a driving power is transmitted by the rollers 132. Obviously, combination of these constructions of the transport unit 130 and other transport mechanism may be applied.

The control unit 160 may control the pick-up unit 120 and the transport unit 130 using signals received from the skew sensing unit 150 and the separation control sensing unit 140. For example, when a passage of one sheet of paper media is sensed by the separation control sensing unit 140, the control unit 160 operates the pick-up unit 120 to thereby induce another sheet to be drawn. When skew of the paper media is sensed by the skew sensing unit 150, the control unit 160 suspends a forward operation of the transport unit 130 and operates a motor of the transport unit 130 backwards, thereby returning the skewed sheet of the paper media to the reception unit 110.

More specifically, the skew sensing unit 150 includes a middle skew sensor 152 disposed in a middle portion of the transport path of the transport unit 130 and side skew sensors 154 and 156 disposed on both sides of the middle skew sensor 152. In this instance, the middle and side skew sensors are consecutively arranged across the transport path, and the side skew sensors 154 and 156 are disposed in a location where a passage of the paper media with the smallest size, from among the various kinds of paper media, is sensed even when the paper media with the smallest size is in close contact with a side end of the transfer path. For example, a transport guide for transporting Euro paper money with a length of about 156 to 160 mm preferably has a width of about 163 mm, a transport guide for transporting Korean paper money with a length of about 161 to 165 mm preferably has a width of about 168 mm, and a transport guide for transporting Chinese paper money with a length of about 166 to 170 mm preferably has a length of about 173 mm.

Referring to FIG. 2, each size of Euro paper money, Korean paper money, and Chinese paper money is illustrated when each paper money with a smallest size is in close contact with a side end of the transport guide. Among these, a 5-Euro paper money has the shortest length of about 156 mm, and accordingly, a distance between the side skew sensors 154 and 156 is maintained to be about 71 mm. The skew sensing unit 150 having the same arrangement and construction as those in the 5-Euro paper money may be maintained even in the case of Korean paper money or Chinese paper money.

Similarly, a 100-Yuan Chinese paper money has the greatest length of about 170 mm, and the 100-Yuan Chinese paper money folded in half has a length of about 85 mm. In this instance, in order to detect the 100-Yuan Chinese paper money folded in half, a distance between a middle separation control sensor and side separation control sensors which will be described as below is maintained to be about 90 mm.

The separation control sensing unit 140 includes a middle separation control sensor 142 disposed on a middle portion of the transport path of the transport unit and side separation control sensors 154 and 156 disposed on both sides of the middle separation control sensor. In this instance, the middle and side separation control sensors are consecutively arranged across the transport path and a distance between the side separation control sensors 144 and 146 and the middle separation control sensor 142 is preferably greater than a distance between the side skew sensors 154 and 156 and the middle skew sensor 152. More specifically, the side separation control sensors 144 and 146 are mounted in such a manner as to maintain a distance of about 45 to 81 mm from the middle separation control sensor 142.

Hereinafter, a method of controlling reception of various kinds of paper media according to an exemplary embodiment of the present invention will be described using the apparatus of controlling reception of various kinds of paper media, in detail.

Figure 3:
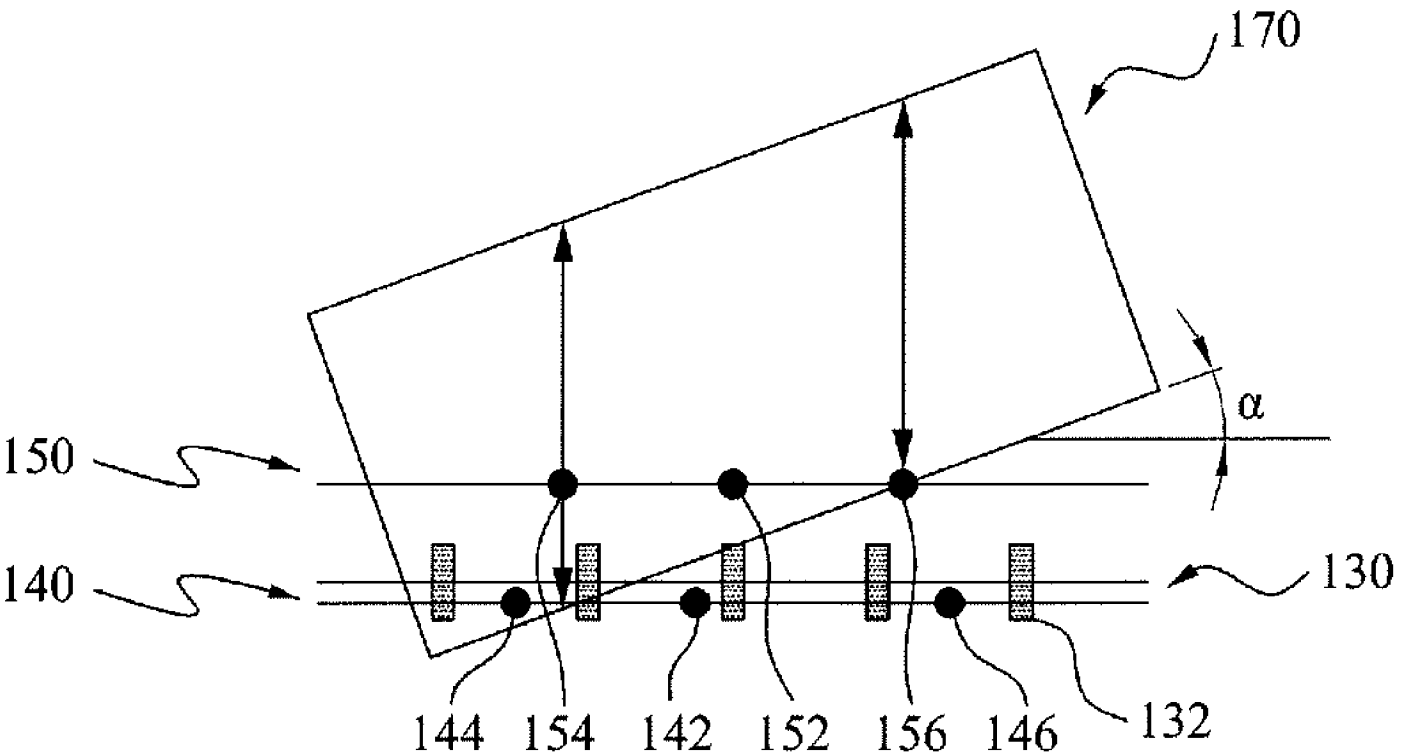
FIG. 3 is a diagram used for describing a process where skewed paper media is transported according to an exemplary embodiment of the present invention.

FIG. 3 is a diagram used for describing a process where skewed paper media is transported according to an exemplary embodiment of the present invention.

In general, when the paper media normally advances along the transport path without any skew of the paper media, the middle skew sensor 152 and the side skew sensors 154 and 156 of the skew sensing unit 150 are simultaneously motivated. For reference, 'motivate' of the present specification denotes reception of stimulation. Specifically, the case where light is transmitted to the sensor, that is, a light state, may be denoted as a normal state, and the case where light is blocked by the paper media, that is, a dark state, may be denoted as a motivated state. Thus, when all sensors of the skew sensing unit 150 are simultaneously motivated, the paper media may be determined to normally pass through a predetermined transport path.

Referring to FIG. 3, the paper media 170 is advancing in a state of being skewed.

In measuring an amount of skew of the paper media 170, the side skew sensor 154 on the left side may be first motivated, and then the side skew sensor 156 on the right side may be motivated. In this instance, a motivated time difference between the side skew sensors 154 and 156 may be calculated to thereby detect a skew angle ($\alpha$) of the paper media 170 using the motivated time difference.

In general, when the skew angle ($\alpha$) is less than about 19.76°, the paper media 170 may be determined as normal paper media, and even when the skew angle ($\alpha$) is within a range of about 19.76 to 20.24°, that is, an acceptable error range, the paper media 170 may be determined as normal paper media. However, when the skew angle ($\alpha$) exceeds 20.24°, that is, beyond an allowable amount of the skew angle, the paper media 170 may be determined as abnormal paper media, and thus a forward operation of the transport unit 130 is suspended and the transport unit 130 is operated backwards.

Figure 4:
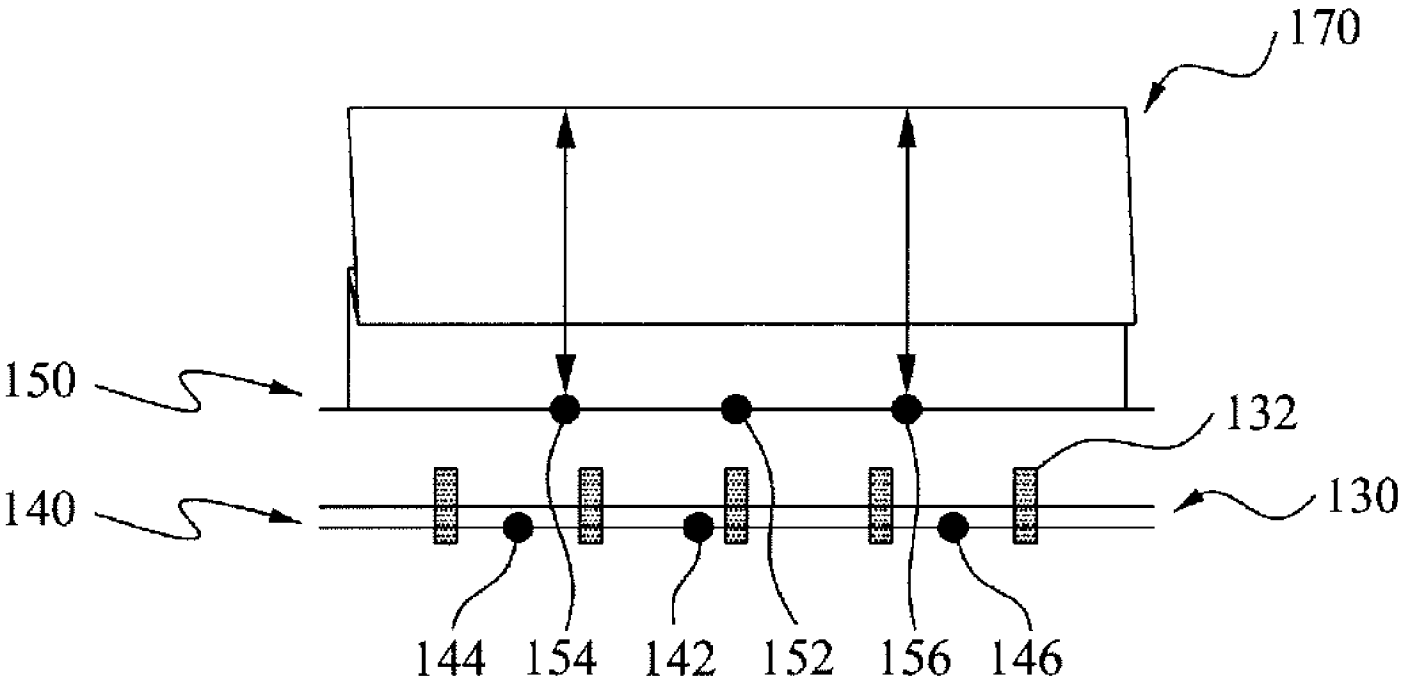
FIG. 4 is a diagram used for describing a process where a length of paper media is detected when passing through a predetermined transport path according to an exemplary embodiment of the present invention.

FIG. 4 is a diagram used for describing a process where a length of paper media is detected when passing through a predetermined transport path according to an exemplary embodiment of the present invention.

Referring to FIG. 4, the time when the side skew sensors 154 and 156 and the middle skew sensor 152 are motivated, that is, the time during which the dark state is maintained, are calculated, and thereby a length of paper media 170 may be calculated using the motivated time. When the length of paper media 170 is less than 40 mm, the paper media 170 may be determined to be folded or torn, and thus a forward operation of the transport unit 130 is suspended. When the length of paper media 170 exceeds 152 mm, it may be determined that at least two sheets of paper media 170 pass through a predetermined transport path in a state of being in significantly close contact with one other, so that the forward operation of the transport unit 130 is suspended, and then the transport unit 130 is operated backwards, thereby returning the at least two sheets of the paper media 170 to the reception unit 110.

For example, when a length of paper media 170 is about 76 to 152 mm based on earlier Korean paper money, it is determined that two sheets of the paper media 170 pass the predetermined transport path in a state of being stacked one on top of another, or being in close contact with each other. In these cases, if the forward operation of the transport unit 130 is suspended, a paper media 170 jam or malfunction of the transport unit 130 may occur, requiring the transport of the paper media 170 to continue. Thus, according to an exemplary embodiment of the present invention, paper media 170 determined to have above-described defects is stored in a predetermined temporary storage unit and then collectively returned to a customer.

Figure 5:
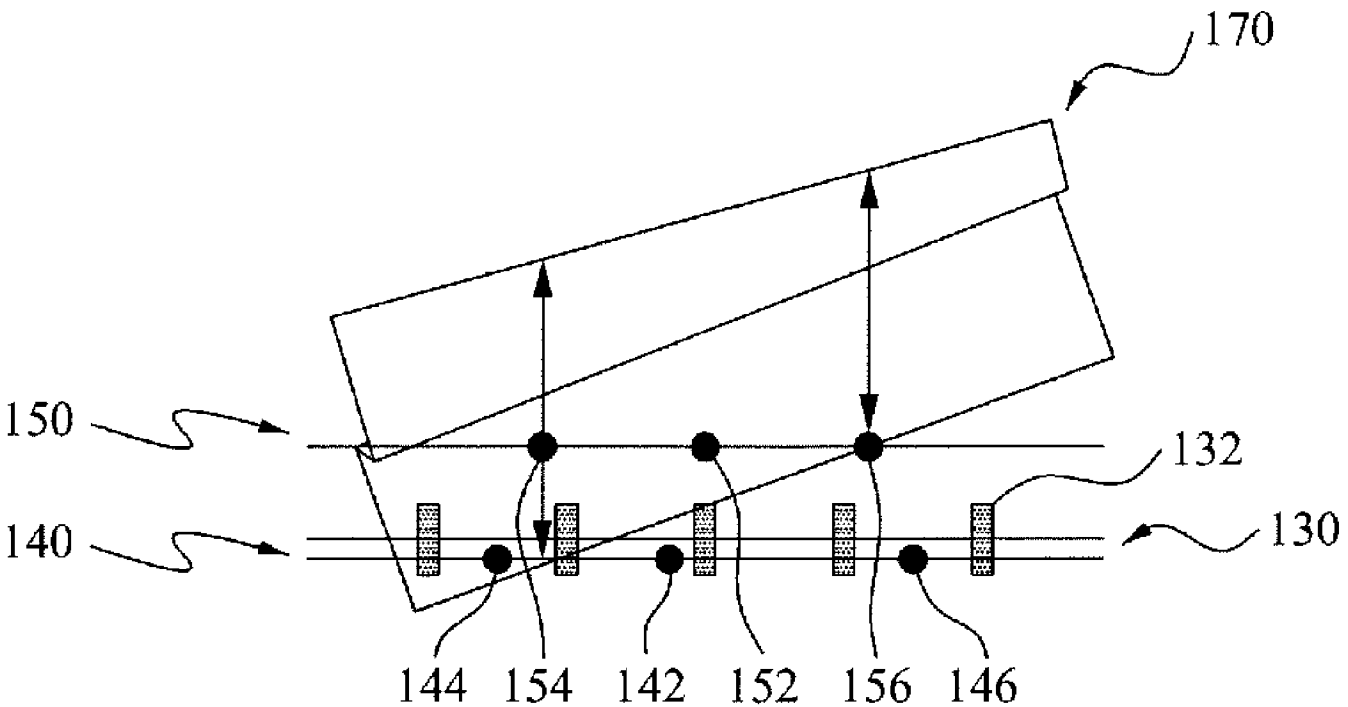
FIG. 5 is a diagram used for describing a process where paper media folded at a skew is detected according to an exemplary embodiment of the present invention.

FIG. 5 is a diagram used for describing a process where paper media folded at a skew is detected according to an exemplary embodiment of the present invention.

Referring to FIG. 5, a time difference between a motivated time of the side skew sensor 154 of left side and a motivated time of the side skew sensor 156 of right side is calculated, and a skew angle is calculated using the time difference. In this regard, when the skew angle is equal to or greater than an allowable amount of skew, the paper media 170 is determined to be asymmetrically folded. In this instance, the control unit 160 suspends forward operation of the transport unit 130 and operates the transport unit 130 backwards.

Figure 6:
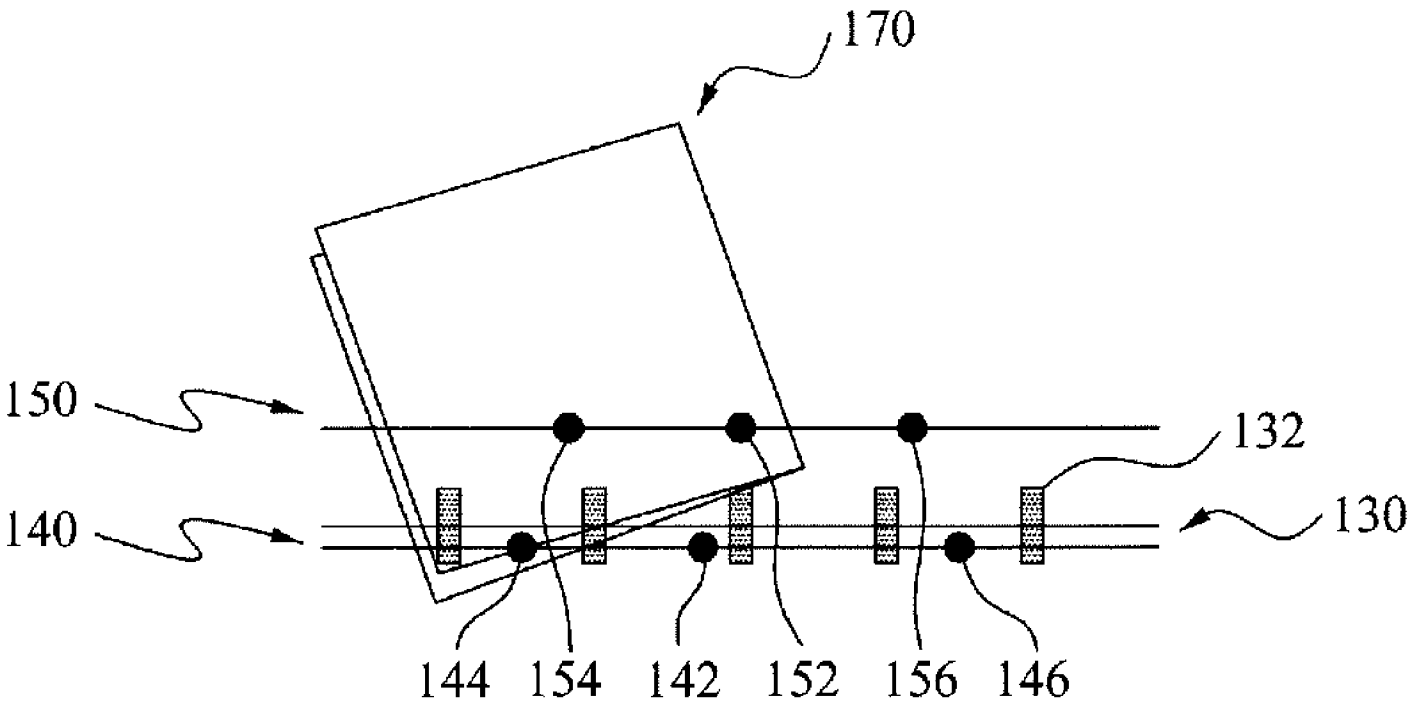
FIGS. 6 through 8 are diagrams used for describing processes where paper media folded in half is detected according to an exemplary embodiment of the present invention.
Figure 7:
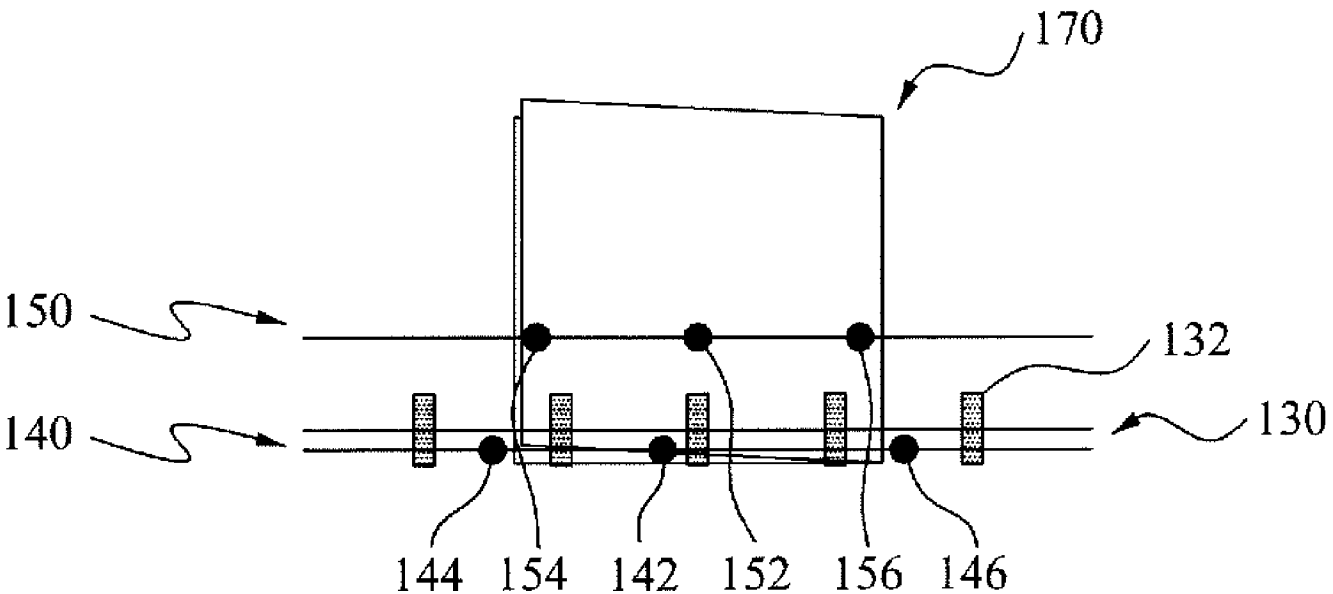
Figure 8:
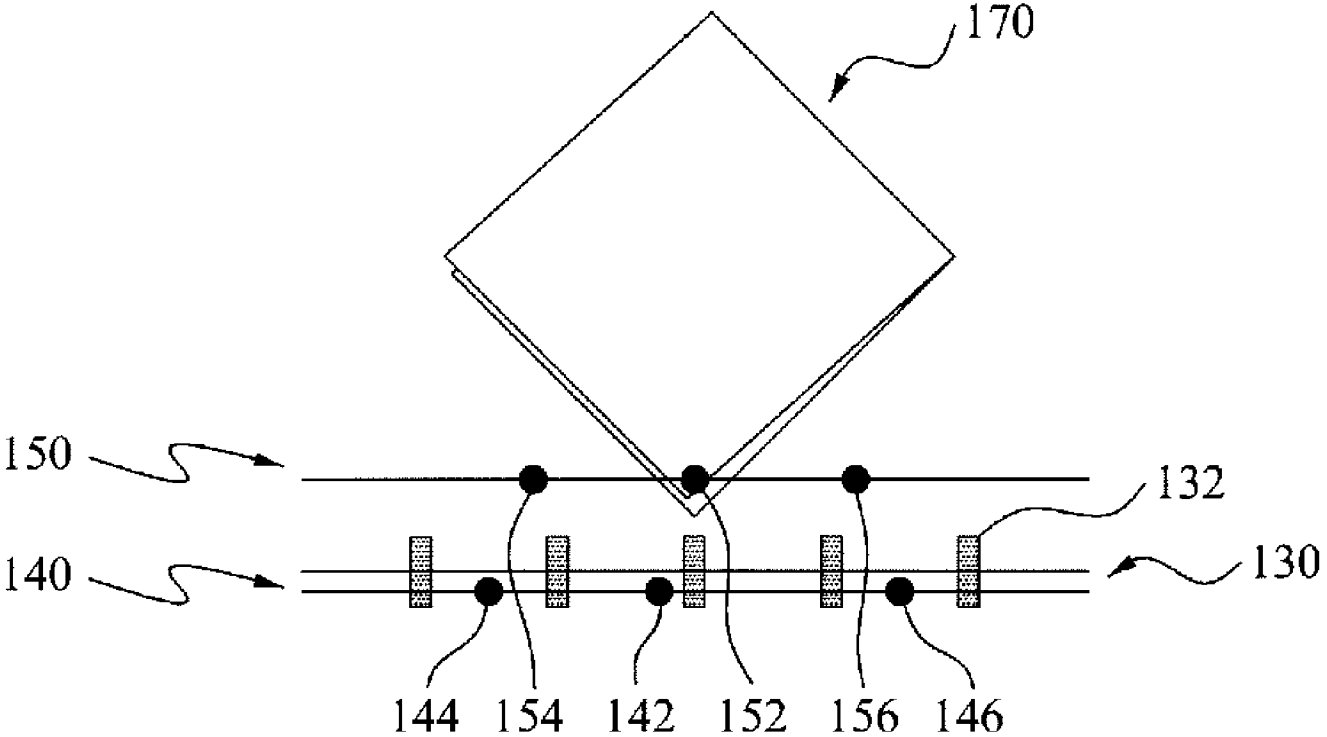

FIGS. 6 through 8 are diagrams used for describing processes where paper media folded in half is detected according to an exemplary embodiment of the present invention.

Referring to FIG. 6, when any one of side skew sensors 154 is motivated and another side skew sensor 156 is not motivated for a reference time period (about 19 ms), it is determined that paper media 170 folded in half passes through a predetermined transport path in a state of being positioned adjacent to a side of the transport path. In this instance, a forward operation of the transport unit 130 is suspended, and the transport unit 130 is operated backwards, thereby returning the paper media 170 to the reception unit 110.

Referring to FIG. 7, when the middle skew sensor 152 and the side skew sensors 154 and 156 are motivated and the side separation control sensors 144 and 146 of the separation control sensing unit are not motivated, it is determined that paper media 170 folded in half passes through the predetermined transport path in a state of being positioned in a middle portion of the transport path without being skewed. In this instance, a forward operation of the transport unit 130 is suspended, and the transport unit 130 is operated backwards, thereby returning the paper media 170 to the reception unit 110.

Referring to FIG. 8, when the middle skew sensor 152 is motivated before the side skew sensors 154 and 156, it is determined that paper media 170 folded in half passes through the predetermined transport path in a state of being positioned in the middle portion of the transport path and being skewed. In this instance, a forward operation of the transport unit 130 is suspended, and the transport unit 130 is operated backwards, thereby returning the paper media 170 to the reception unit 110.

As described above, according to the present invention, various kinds of paper media is readily processed, and abnormalities of paper media and abnormal position of the paper media such as skew of the paper media and the like are detected.

According to the present invention, paper media having abnormalities and abnormal positioning is prevented from being processed in an automatic transaction machine, so that the malfunction of the automatic transaction machine is prevented from occurring, thereby facilitating maintenance and repair of the automatic transaction machine.

According to the present invention, configuration and arrangement of sensors are maintained taking into consideration various kinds of paper media such as Euro, Yuan, Won, and the like, to be applicable to an automatic transaction machine handling with various kinds of paper media by merely modifying a paper media guide for guiding the transport of the paper media.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. An apparatus for controlling reception of various kinds of paper media, the apparatus comprising:

a reception unit to allow the various kinds of paper media to be received;

a pick-up unit to pick up the paper media from the reception unit one sheet at a time;

a transport unit to transport the paper media picked up by the pick-up unit;

a separation control sensing unit mounted on the transport unit to sense whether the paper media is passing through a predetermined transport path;

a skew sensing unit mounted on the transport unit between the reception unit and the separation control sensing unit to sense skew of the paper media; and a control unit to operate the pick-up unit when the separation control sensing unit senses the paper media passing, and to suspend a forward operation of the transport unit and operate the transport unit backwards when the skew sensing unit senses the skew of the paper media.

2. The apparatus of claim 1, wherein the skew sensing unit includes a middle skew sensor disposed in a middle portion of the transport path of the transport unit, and at least one side skew sensor disposed on each side of the middle skew sensor, respectively, the middle and side skew sensors being consecutively arranged across the transport path, and at least one of the side skew sensors is disposed in a location where a passage of the paper media with the smallest size, from among the various kinds of paper media, is sensed even when the paper media with the smallest size is in close contact with a side end of the transfer path.

3. The apparatus of claim 2, wherein at least one of the side skew sensors is mounted in such a manner as to maintain a distance of 35.5 mm or less from the middle skew sensor.

4. The apparatus of claim 2, wherein the separation control sensing unit includes a middle separation control sensor disposed on a middle portion of the transport path of the transport unit and at least one side separation control sensor disposed on each side of the middle separation control sensor, respectively, the middle and side separation control sensors being consecutively arranged across the transport path, and a distance between at least one of the side separation control sensors and the middle separation control sensor is greater than a distance between at least one of the side skew sensors and the middle skew sensor.

5. The apparatus of claim 4, wherein at least one of the side separation control sensors is mounted in such a manner as to maintain a distance of 45 to 81 mm from the middle separation control sensor.

6. A method for controlling reception of various kinds of paper media, the method comprising:

picking up one sheet of paper media from among the paper media received from a reception unit receiving the paper media;

transporting the picked up paper media using a transport unit;

measuring an amount of skew of the paper media using a skew sensing unit mounted on the transport unit;

maintaining a forward operation of the transport unit only when a skew angle measured by the skew sensing unit is equal to or less than an allowable amount of skew;

sensing whether the paper media is passing through a predetermined transport path using a separation control sensing unit mounted on the transport unit;

picking up another sheet of paper media from among the paper media received from the reception unit after verifying the paper media is passing through the predetermined transport path;

transporting, to the separation control sensing unit via the skew sensing unit, the paper media picked up from the reception unit, when a forward operation of the transporting unit is being performed; and when the skew angle measured by the skew sensing unit exceeds the allowable amount of skew, suspending a forward operation of the transport unit and operating the transport unit backwards.

7. The method of claim 6, wherein the skew sensing unit includes a middle skew sensor disposed on a middle portion of the transport path and at least one side skew sensor disposed on each side of the middle skew sensor, respectively, the middle and side skew sensors being consecutively arranged across the transport path, and at least one of the side skew sensors is disposed in a location where a passage of the paper media with the smallest size, from among the various kinds of paper media, is sensed even when the paper media with the smallest size is in close contact with a side end of the transfer path.

8. The method of claim 7, wherein at least one of the side skew sensors is mounted in such a manner as to maintain a distance of 35.5 mm or less from the middle skew sensor.

9. The method of claim 7, wherein the separation control sensing unit includes a middle separation control sensor disposed on a middle portion of the transport path of the transport unit and at least one side separation control sensor disposed on each side of the middle separation control sensor, respectively, the middle and side separation control sensors being consecutively arranged across the transport path, and at least one of the side separation control sensors is disposed in such a manner that a distance between at least one of the side separation control sensors and the middle separation control sensor is greater than a distance between at least one of the side skew sensors and the middle skew sensor.

10. The method of claim 9, wherein at least one of the side separation control sensors is mounted in such a manner as to maintain a distance of 45 to 81 mm from the middle separation control sensor.

11. The method of claim 7, wherein the measuring of the amount of the skew of the paper media calculates a time difference between a motivated time of any one of the side skew sensors and a motivated time of another side skew sensor, calculates the skew angle using the time difference, and maintains a forward operation of the transport unit only when the skew angle is equal to or less than 20.24°.

12. The method of claim 7, wherein the measuring of the skew of the paper media further includes calculating a motivated time when any one of the side skew sensors and the middle skew sensor is motivated, calculating a size of the paper media using the motivated time, and suspending a forward operation of the transport unit and operating the transport unit backwards.

13. The method of claim 7, wherein the measuring of the skew of the paper media further includes calculating a time difference between a motivated time of any one of the side skew sensors and a motivated time of another side skew sensor, and when the paper media is determined to be folded using the time difference, suspending a forward operation of the transport unit and operating the transport unit backwards.

14. The method of claim 7, further comprising: when any one of the side skew sensors is motivated and another side skew sensor is not motivated for a predetermined time period, suspending a forward operation of the transport unit and operating the transport unit backwards.

15. The method of claim 7, further comprising: when the middle skew sensor is motivated before any one of the side skew sensors, suspending a forward operation of the transport unit and operating the transport unit backwards.

* * * * *